United States Patent [19]

Lindblad

[11] 4,290,760

[45] Sep. 22, 1981

[54] MANEUVERING DEVICE FOR SAILING BOATS

[76] Inventor: Karl-Erick Lindblad, Annelundsvägen 22, S-441 00 Alingsas, Sweden

[21] Appl. No.: 61,176

[22] Filed: Jul. 27, 1979

[30] Foreign Application Priority Data

Aug. 8, 1978 [SE] Sweden ..... 7808462

[51] Int. Cl.[3] ..... B63H 25/06

[52] U.S. Cl. ..... 440/51; 440/53; 440/900; 440/76; 114/162; 114/39

[58] Field of Search ..... 416/142 R, 142 A; 114/39, 162–169; 115/17, 18 R, 34 R, 35, 41 R; 440/51, 53, 900, 76

[56] References Cited

U.S. PATENT DOCUMENTS

| | | | |
|---|---|---|---|
| 600,874 | 3/1898 | Jones | 114/162 |
| 2,316,022 | 4/1943 | Rippingille | 114/162 |
| 3,107,644 | 10/1963 | Munson | 115/18 |
| 3,139,062 | 6/1964 | Seefe | 115/18 |
| 3,715,171 | 2/1973 | Settner | 416/142 A |
| 4,089,289 | 5/1978 | Kauder | 440/51 |

*Primary Examiner*—Trygve M. Blix
*Assistant Examiner*—D. W. Keen

[57] ABSTRACT

The invention relates to the provision of an easily operated maneuvering device for sailing boats, which gives the boat in question a maximum of maneuverability also at low travelling speeds and without causing any flow resistance worth mentioning in connection with higher speeds. The device essentially comprises a rudder positioned in the stern of the boat and exhibiting a propulsion apparatus, the power direction of which coincides with the vertical symmetrical plane of the rudder.

4 Claims, 7 Drawing Figures

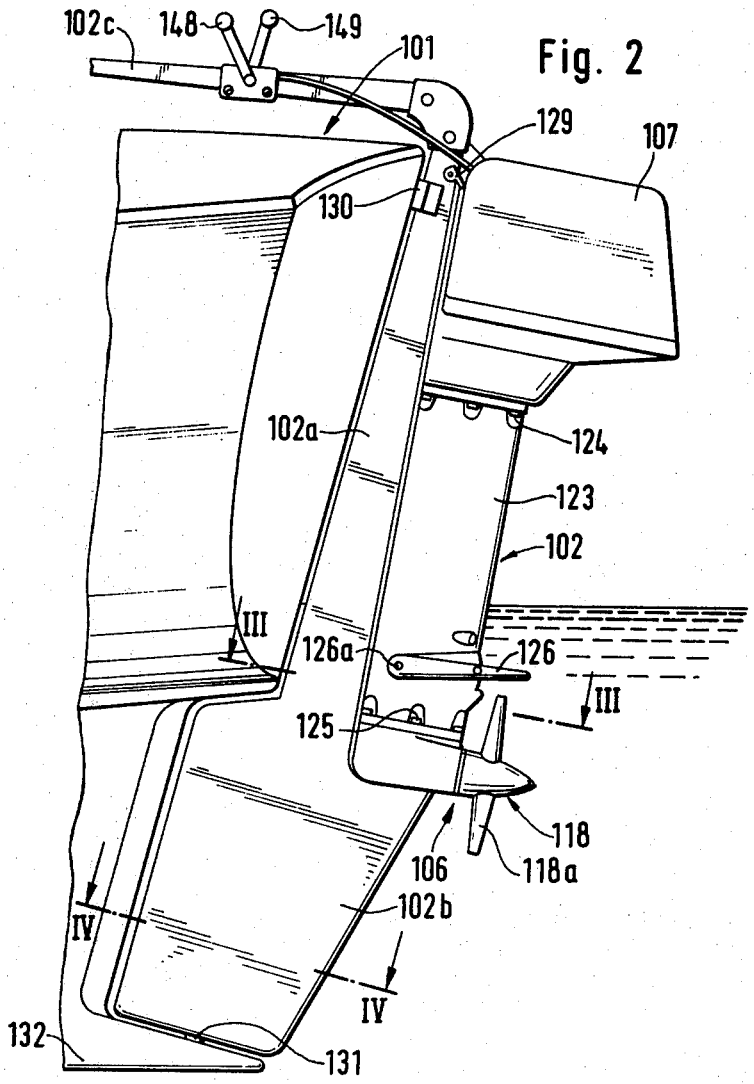
Fig. 2
Fig. 3
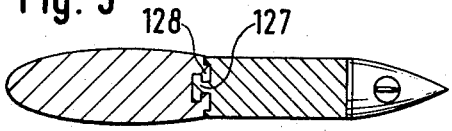
Fig. 4
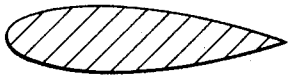

MANEUVERING DEVICE FOR SAILING BOATS

The present invention relates to a manoeuvering device for sailing boats.

For a long time it has been a known problem that it can be very difficult to maneuver sailing boats by means of the sails only in narrow passages, by way of example in harbours or otherwise, where the speed of the boat is so low that the necessary steerage-way does not exist. Under certain circumstances it can also be a problem to perform a rapid sheer or other maneuvering operation in order to get out of the way.

In order to obtain steerage-way without the aid of the sails, so that the maneuverability of sailing boats to some extent can be improved, it is known to equip the boat with an inboard motor with a propeller positioned in front of the rudder. However, the power direction of the propeller is kept unchanged during all conditions of operation, which means that also this type of sailing boat can be very difficult to maneuver at low speed, as also in this cas a not inconsiderable speed is required in order to make the rudder function properly. Thus, only very slow yaws of the boat can be performed at low speed, which means that a certain change of direction does require a comparatively long travelling distance of the boat. Another measure in order to facilitate the maneuverability of the boat under the conditions mentioned involves the installation of an outboard motor at the side of the ordinary rudder of the boat. However, such an arrangement implies that when sailing the outboard motor has to be tilted upwards, as it otherwise would produce too great a flow resistance in the water. The fact that it must be maneuvered together with the ordinary rudder in order to permit a reasonable maneuverability of the boat constitutes another problem.

It is an object of the invention to provide a device eliminating the problems mentioned, which device can be made to function very quickly, when difficult conditions arise, so that the boat can be brought to make a very sharp yaw, while the device at the same time permits a very simple handling, and an aesthetically attractive appearance of the boat can be conserved.

Said object is reached by means of a maneuvering device made according to the invention, which essentially is characterized by the rudder of the boat having a propulsion means following the movements of the rudder, the propulsion effect of said means relative to the water surrounding the rudder being substantially directed along the vertical center plane of the rudder.

Figure 1:
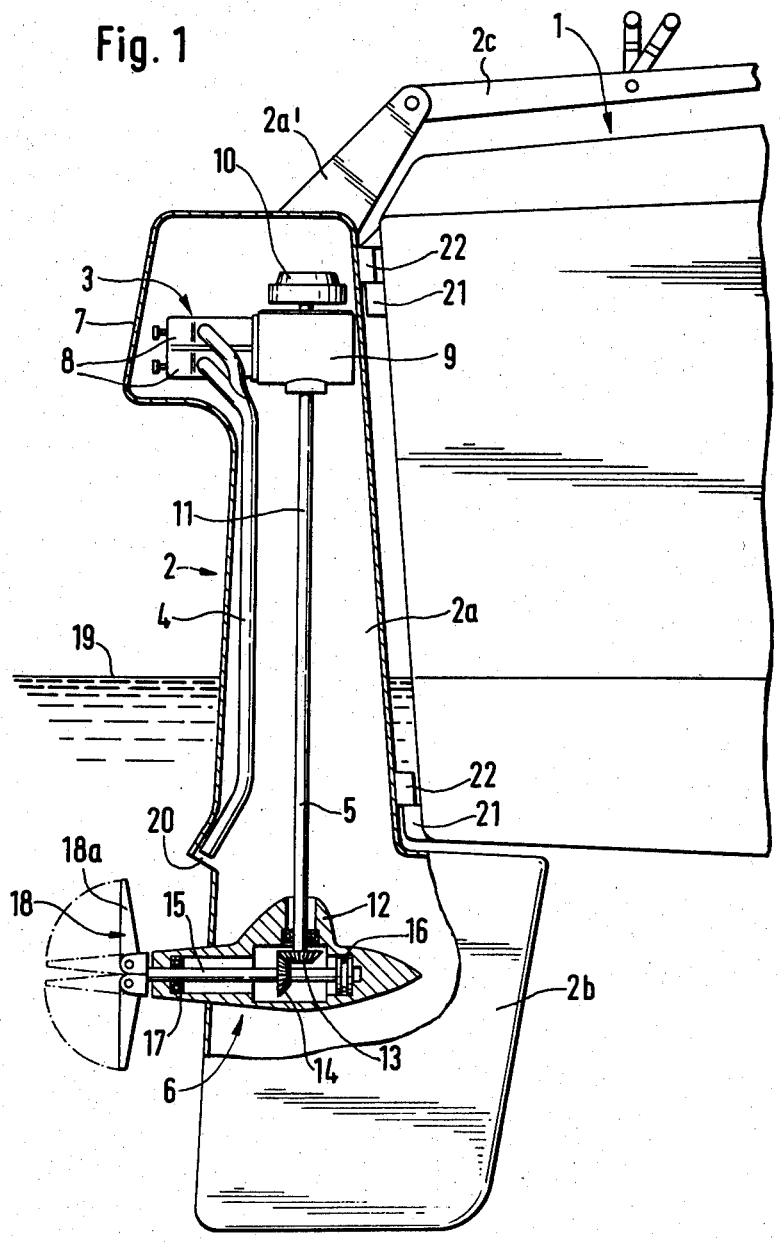
Figure 5:
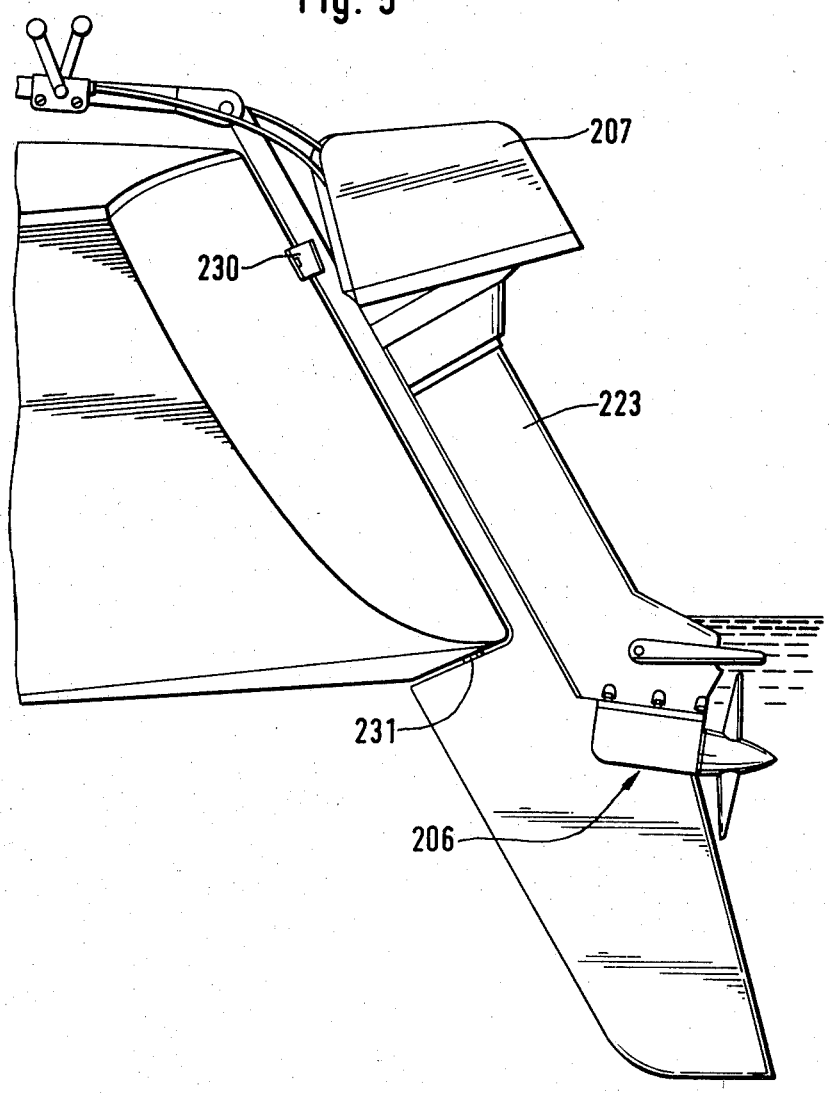
Figure 6:
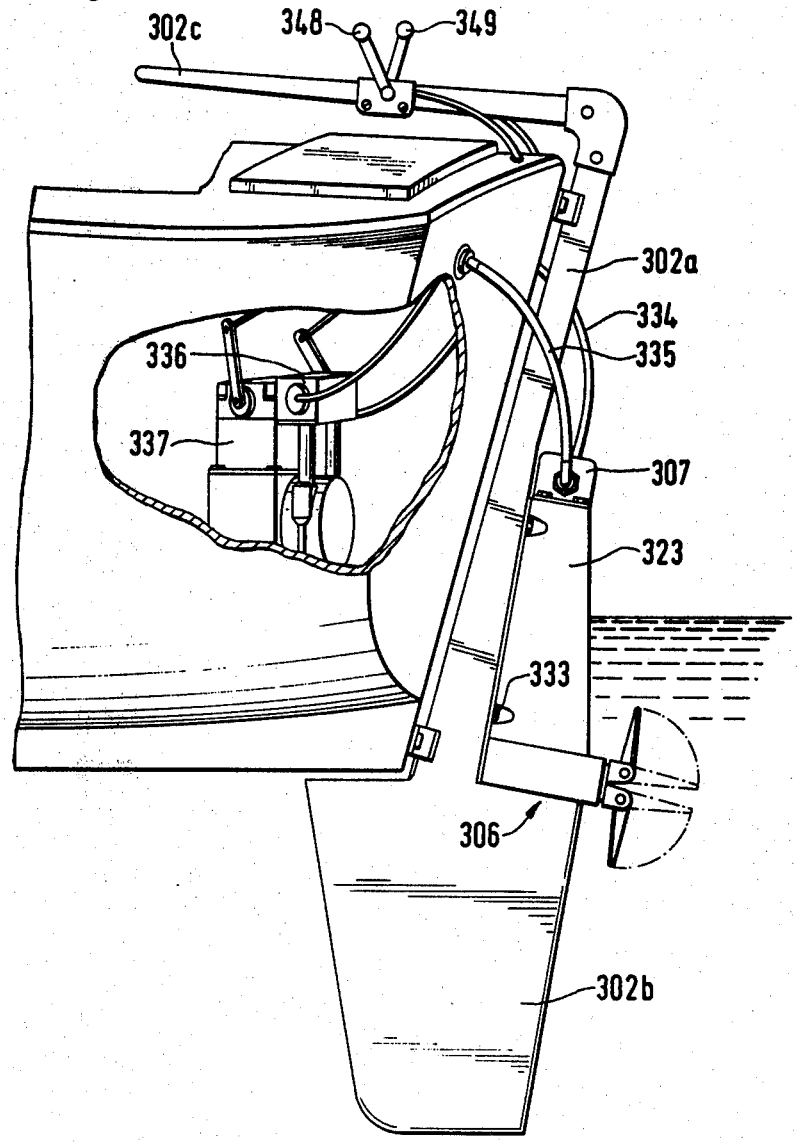
Figure 7:
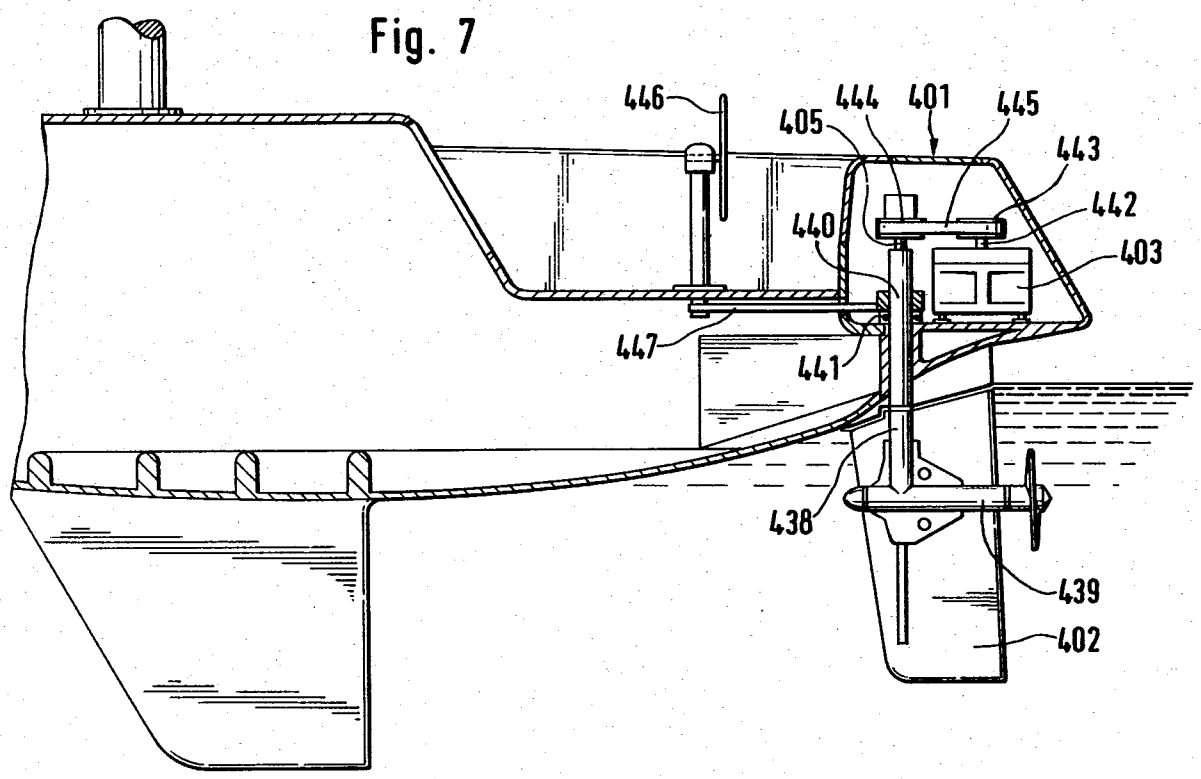

The invention is described in the following with reference to the accompanying drawings, in which FIG. 1 is a schematical cross-sectional view of a manoeuvering device designed according to the invention and positioned on the stern of a sailing boat, FIG. 2 is a side elevational view of a device according to a second embodiment of the invention, FIG. 3 is a cross-sectional view of the device illustrated in FIG. 2 along the line III—III in FIG. 2 on an enlarged scale, FIG. 4 is a corresponding cross-sectional view along the line IV—IV in FIG. 2, FIG. 5 is a side elevational view of a manoeuvering device according to the invention positioned on a sailing boat with a counter of negative inclination, FIG. 6 is a partially cut out side elevational view of the stern of a sailing boat, which is provided with a device according to an additional variant of the invention, and FIG. 7 illustrates still another variant of the invention.

In FIG. 1 the stern 1 of a sailing boat is provided with a maneuvering device 2 designed according to the invention, which is schematically illustrated, i.e. only the outer contours of the rudder installation are shown as well as important contours of a driving engine 3 with an exhaust system 4 vertically extending through the rudder, and a driving shaft 5. Underneath, the rudder there is a propeller unit 6. The main piece of the rudder is indicated with 2*a*, the rudder plate is indicated with 2*b*, and the helm or tiller is indicated with 2*c*. The helm 2*c* is connected with an upwards projecting portion 2*a*' of the main piece 2*a* of the rudder. In the embodiment shown the main piece 2*a* of the rudder and its upper portion are designed with an inner hollow space, the upper portion of the main piece of the rudder supporting a hood 7 enclosing the engine 3. The engine 3 in the illustrated example of the embodiment comprises a combustion engine with two cylinders 8, a crankcase 9, and a flywheel 10. The crankshaft of the engine is connected to a driving shaft 11 extending in downwards direction through the main piece 2*a* of the rudder, the extreme bottom portion of said driving shaft extending into a casing 12, where it supports a miter gear 13 which engages a corresponding bevel gear 14 of the propelling shaft 15 of the propeller element. The propelling shaft 15 is journalled in the forepart of the housing 12 by means of a thrust bearing 16 and in the rear part of the housing by means of a radial bearing 17. A propeller 18 of folding-up type is mounted on the extreme end of the propelling shaft, the propeller blades 18*a* of this propeller type permitting their being folded from the working position indicated with continuous lines in the drawing into the disengaged position indicated with broken lines, in which latter position the propeller does not offer any resistance worth mentioning in the water during the progress of the boat, and when the engine is not operating. The exhaust tube 4 of the engine debouches in an opening 20 of the rudder casing located below the surface 19 of the water. The rudder is attached to the stern by means of cooperating hinged ears 21, 22, which are connected by means of a pivot pin, not shown in the drawing. The rudder installation with its engine can possibly be removed as a whole unit from the boat by lifting of the rudder and separation of the hinged ears 21, 22. The engine unit 3 with the hood 7 belonging to the same, the portion of the rudder encasing the exhaust pipe 4, and the transmission shaft 5 can together with the propeller unit 6 possibly be detachably connected with the remaining part of the rudder and in such a manner that only the propeller unit can be lifted off the rudder, while the rudder conserves it steering function. This separation can suitably extend in the vertical direction of the rudder along the transmission shaft 5. An insertion piece, by means of which the engine can be substituted, if one does not wish to use the same during a prolonged lapse of time, can also form part of the rudder assembly. The housing, which encloses the miter gear assembly 13, 14 between the transmission shaft 5 and the propelling shaft 15, can suitably have such an exterior shape that there will not be any bulges on the lateral surfaces of the rudder. The illustrated rudder installation therefore offers an extremely feeble flow resistance, when the boat is sailing, and when the propeller blades 18*a* are in their backwards folded inactive position. When the propeller 18 is operating, it produces a driving force, which is directed along the vertical center plane of the rudder, i.e. a driving force the direction of which follows the rudder in its pivoting movement and thus acts on the boat in an efficient manner, also when the speed is very slow. The engine, which also suitably can be provided with a reversing gear, makes moreover an efficient maneuvering of the boat possible, when it goes astern. The illustrated engine can in case of quickly arising emergency situations immediately be started in order to perform rapid yaws, when the speed of the immediately preceding movement is very slow. This is a much valued feature in for example congested harbours.

A second example of an embodiment of a device according to the invention mounted on the stern of a sailing boat with positive inclination of the stern is illustrated in FIG. 2. In this figure the stern of the boat in its entirety is indicated with 101 and its rudder assembly in its entirety with 102. The rudder blade is indicated with 102*b* and the main piece of the rudder is indicated with 102*a*. A hood 107 encloses a driving engine, which suitably can be of the same kind as the one illustrated in FIG. 1, and the propeller unit 106 can suitably be connected with the driving engine via a transmission shaft corresponding to the one illustrated in FIG. 1. The hood 107 and the covering hood of the propeller unit 106 are connected by means of an intermediate covering hood 123, which at its top is connected with the engine hood 107 by means of a screw joint 124 and at its bottom is connected with the propeller housing by means of a screw joint 125. A cavitation plate 126 is pivoted on the hood 123 via a transmission shaft 126*a* above the propeller unit 106. The cavitation plate can be vertically pivoted round the shaft 126*a*. The part 123 and the propeller unit 106 are fixed to the main part 102*a* of the rudder by means of a sliding guide portion 127 on the engine part and a sliding guide portion 128 on the main piece of the rudder, said sliding guides cooperating with each other in such a way that the engine unit with the propeller unit can be lowered down as from above along the main part of the rudder. By means of a pawl 129 the engine unit is locked, so that it cannot unintentionally be lifted upwards. The hood 123 and the propeller unit 106 with respect to their exterior contour suitably follow the shape of the remaining portion of the rudder. The section illustrated in FIG. 3 is taken along the line III—III in FIG. 2, and the section illustrated in FIG. 4 is taken along the line IV—IV in FIG. 2. The propeller of the propeller unit is indicated with 118, and its blades are indicated with 118*a*. The propeller blades illustrated in this embodiment are suitably foldable in such a manner that in inactive position they still are at an essentially right angle to the propeller shaft, but essentially point in the direction of movement of the boat, so that the least possible flow resistance of the water is produced, when the propeller does not work. It is of course also possible within the scope of the invention to disengage the propeller, when it is not of the folding type, so that it can rotate freely in the water. It is of course also possible to use a folding propeller of the kind illustrated in FIG. 1. The engine unit is manoeuvered by means of the manoeuvering device 148 and 149 mounted on the helm 102*c*. The rudder is hinged to the boat via an upper hinge 130 at the upper portion of the stern and a lower hinge 131, which is mounted on a lower projecting portion of the keel 132 at the stern of the boat.

In FIG. 5 an example of embodiment is shown, where the invention finds an application in a boat with so called negative inclination of its stern. In this case the rudder is attached to the stern of the boat by means of an upper and a lower hinge 230 and 231 respectively. The parts, which correspond to the parts illustrated in the FIG. 2 carry the same indications as in the figure described in the foregoing, but with the difference that the first digit of the one hundreds series has been replaced with a digit 2 in a two hundred series. In this embodiment the propeller unit 206 still substantially has the same direction as in the embodiment illustrated in FIG. 2, where the propeller is pointing in backwards direction away from the stern and has a slight downwards inclination. The covering hood 207, which encloses the engine unit, has likewise been maintained in as horizontal a position as possible. This means that the covering hood 223 extending between the engine hood 207 and the propeller unit 206 has been given a somewhat different design in order to adapt to the angles shown of the engine hood and the propeller unit. Also the engine inside the covering hood 207 is still in substantially the same position as in FIG. 2, which means that the transmission shaft extending between the engine block and the propeller shaft at both its extremes must have a link, which suitably is of the universal joint type. Remaining parts of the device are in accordance with the previously described embodiment with the exception that the sliding guide, by means of which the engine unit is attached to the remaining portion of the rudder, has been omitted. The fixation in the embodiment shown must be made in a different manner, for example by means of suitable clamps. When the front edge of the covering hood 223 is more accurately adapted to the shape of the propeller unit 206, such a sliding guide can also be used in this embodiment.

In the embodiment illustrated in FIG. 6 the parts, which correspond to identical details of the preceding examples of embodiment, carry the corresponding reference indications, but with the difference that the first digit in the hundreds series has been replaced with the digit 3 in a three hundreds series. Thus, the main piece of the rudder is indicated with 302*a*, the rudder plate with 302*b*, and the helm with 302*c*. The maneuvering members mounted on the helm are indicated with 348 and 349. In the illustrated embodiment the propeller unit 306 is driven by means of a hydraulic motor, which is enclosed in an upper hood 307, which in turn is connected with the propeller unit by means of an intermediate covering hood 323, in the interior of which a transmission shaft connecting the hydraulic motor with the propeller unit extends. The propulsion unit formed accordingly is connected with the main piece 302*a* of the rudder by means of bolt joints 333. The hydraulic motor placed on the rudder is served by two pipes for hydraulic fluid 334 and 335 from a hydraulic pump 336 placed in the interior of the stern of the boat, said pump in turn being driven by a combustion engine 337. The hydraulic pump can suitably also be provided with a reversing valve, which is controlled by means of one of the controls mounted on the helm. The speed of the motor is regulated by means of the other control.

In FIG. 7 still another variant is shown, where the rudder plate 402 in its entirety is placed underneath the stern 401 of the boat. A tube assembly is by means of casting incorporated into the rudder blade and has a vertical tube 438 and a horizontal tube 439, of which the horizontal tube encloses the propeller shaft and the bearings for the same, whereas the vertical tube encloses a driving shaft for the propeller, which shaft is connected with the propeller shaft via a miter-wheel gearing of suitable type. The vertical tube 438 extends in upwards direction through the bottom of the hull of the boat and at its top has a supporting projection 440, which rests on a thrust bearing 441. The propeller shaft is driven by a motor 403 via a pulley 443 mounted on the motor shaft 442, a pulley 444 mounted on the vertical transmission shaft 405, and a belt 445 extending between these pulleys. Thus, the vertical tube 438 is from a pivoting viewpoint rigidly connected with the rudder and is maneuvered from the steering wheel 446 via the transmission element 447.

The invention is not limited to the embodiments described above by way of example only, which can be varied as to their details within the scope of the following claims without therefore departing from the fundamental idea of the invention. Thus, combinations of the elements forming part of the different variants can of course be imagined. The invention is moreover not limited to the driving means illustrated in the drawings, but one can of course also imagine jet propulsion, if this would be considered to be suitable.

I claim:

1. Maneuvering device for sailing boats comprising a rudder, and propulsion means comprising a propeller unit and driving means therefore incorporated in the rudder so that the propulsion effect of said propulsion means relative to the water surrounding the rudder will be substantially directed along the vertical center plane of the rudder, said propulsion means being incorporated into a separate unit comprising a readily detachable insertion part of the rudder having a shape following the form of the rudder, quick coupling means for connecting said insertion part to the remainder of the rudder and for the removal of same, and a separate piece also having a shape following the form of the rudder and quick coupling means for connecting same to the remainder of the rudder, whereby said insertion part can be quickly substituted by said separate piece to fill the space left by said insertion part when the latter is removed, and said insertion part and said separate piece when connected to the remainder of the rudder cooperating with the latter to make a complete rudder having smooth side surfaces and a very low flow resistance.

2. Maneuvering device according to claim 1, wherein said means for connecting and removing said insertion part to and from the remainder of the rudder is formed as a sliding guide extending in the vertical direction of the rudder in a manner such that the insertion part can be disengaged from the rudder by lifting up of the propeller unit and the driving means relative to the remainder of the rudder.

3. Maneuvering device according to claim 1 or 2, wherein the propeller unit and driving means are connected by a shaft, which is articulated at its ends, in order to adapt the device to different inclinations of the main part of the rudder and to the stern of the boat, while maintaining a substantially horizontal position of the driving means and the propeller unit.

4. Maneuvering device according to claim 1 or 2, wherein the propeller is of the folding type having blades pivotable in a direction aft away from the boat into a position in which they coincide with the course of the boat.

* * * * *